US009390832B2

(12) United States Patent
Tai et al.

(10) Patent No.: US 9,390,832 B2
(45) Date of Patent: Jul. 12, 2016

(54) METHOD FOR FABRICATING A CONDUCTIVE PASTE

(71) Applicant: National Tsing Hua University, Hsinchu (TW)

(72) Inventors: Nyan-Hwa Tai, Hsinchu (TW); Chi-Young Lee, Hsinchu (TW); Hwei-Jay Chu, Hsinchu (TW)

(73) Assignee: NATIONAL TSING HUA UNIVERSITY, Hsinchu (TW)

( * ) Notice: Subject to any disclaimer, the term of this patent is extended or adjusted under 35 U.S.C. 154(b) by 236 days.

(21) Appl. No.: 14/103,300

(22) Filed: Dec. 11, 2013

(65) Prior Publication Data

US 2014/0158948 A1 Jun. 12, 2014

(30) Foreign Application Priority Data

Dec. 11, 2012 (TW) ..... 101146602 A

(51) Int. Cl.
*H01B 1/24* (2006.01)

(52) U.S. Cl.
CPC ..... *H01B 1/24* (2013.01)

(58) Field of Classification Search
CPC ..... H01B 1/24
USPC ..... 252/511, 500; 524/424
See application file for complete search history.

(56) References Cited

U.S. PATENT DOCUMENTS

2006/0057451 A1* 3/2006 Okuzaki ..... C08J 3/075 524/379
2010/0294353 A1* 11/2010 Takahashi ..... C09D 5/24 136/256
2012/0119153 A1* 5/2012 Choi ..... H01B 1/22 252/500

FOREIGN PATENT DOCUMENTS

CN 101486849 A 7/2009
TW 200827385 A 7/2008

* cited by examiner

*Primary Examiner* — Rabon Sergent
*Assistant Examiner* — Deve E Valdez
(74) *Attorney, Agent, or Firm* — Muncy, Geissler, Olds & Lowe, P.C.

(57) ABSTRACT

The present invention provides a method for fabricating a conductive paste comprising the following steps: (a) preparing an organic medium and a mixed powder, wherein the organic medium contains an organic solvent, a resin and a first anionic surfactant, and the mixed powder contains a carbide and a doped-polyaniline, wherein the doped-polyaniline is produced by co-doping a polyaniline with a second anionic surfactant in an acid; and (b) mixing the organic medium and the mixed powder to obtain the conductive paste, which has a significantly improved conductivity.

13 Claims, 1 Drawing Sheet

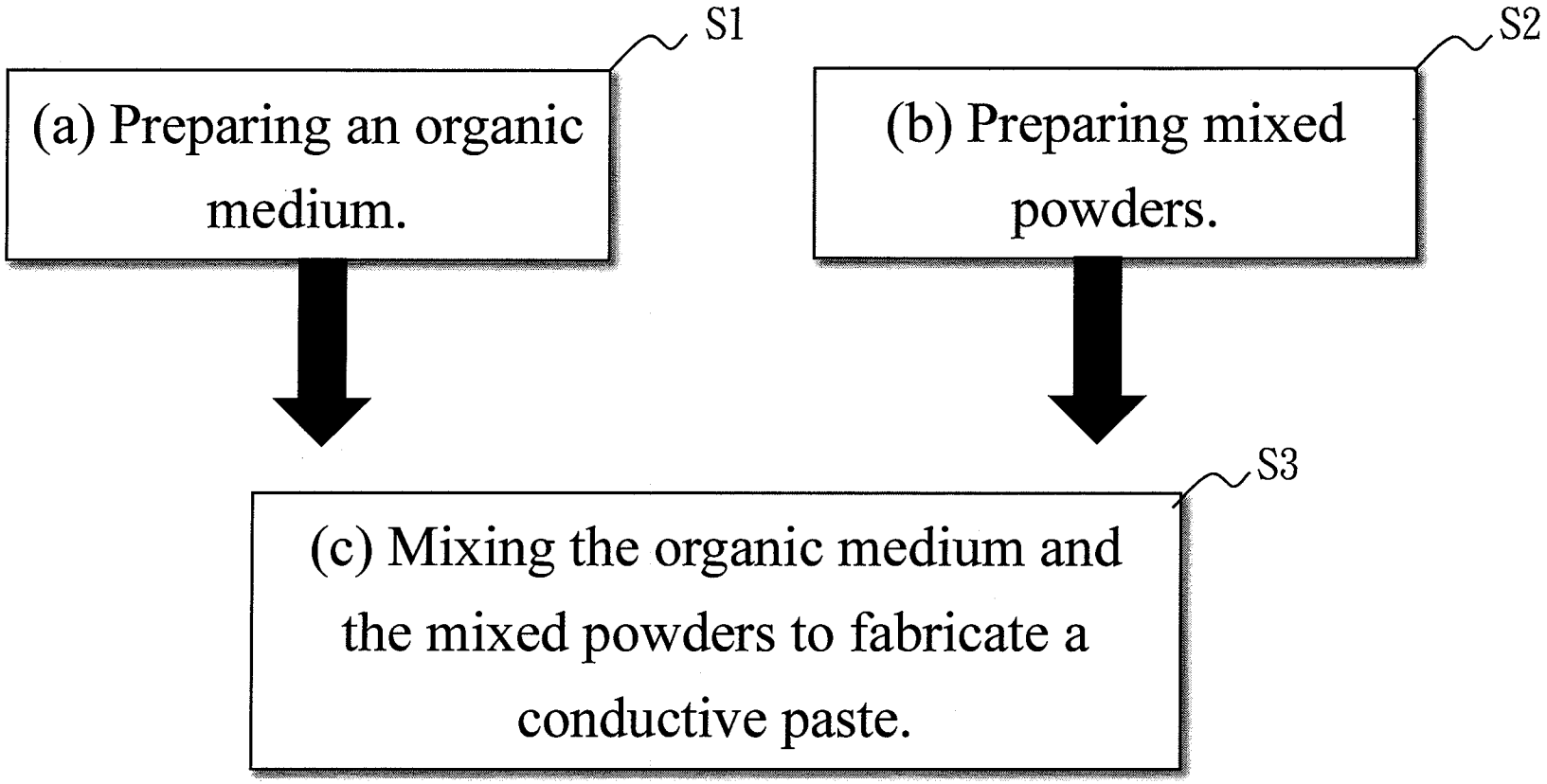
S1
(a) Preparing an organic medium.
S2
(b) Preparing mixed powders.
S3
(c) Mixing the organic medium and the mixed powders to fabricate a conductive paste.

METHOD FOR FABRICATING A CONDUCTIVE PASTE

CROSS REFERENCE TO RELATED APPLICATION

This application claims the benefits of the Taiwan Patent Application Number 101146602, filed on Dec. 11, 2012, the subject matter of which is incorporated herein by reference.

BACKGROUND OF THE INVENTION

1. Field of the Invention

The present invention relates to a method for fabricating a conductive paste. According to the present method, the conductivity of the conductive paste can be significantly improved after a sintering process. 2. Description of Related Art Conductive paste composed of a resin and a plurality of conductive particles is an adhesive agent having electrical conductivity after curing or drying, in which the conductive particles in collaborate with resin form a conductive path which can be applied in the fabrication of electronic devices. Owing to the excellent conductivity and the adhesive capability of the conductive paste, it is a promising material to replace the conventional solder so as to improve the productivity of the electronic devices and to apply to the materials with poor heat resistance or unable to be soldered.

The conductive paste usually used in the fabrication of micro-device, such as an integrated circuit, a light-emitting diode chip, or a printed circuit. In addition, it can also be applied to the communication systems, the vehicle industries and the medical equipment, which are fabricated by using the traditional solder. Further, for example, in the biomedical field, the conductive paste can also be applied to the blood glucose meter to enhance its functions.

The quality of the conductive paste is determined by the fabricating process and the composition thereof, for example, the uniformity of the dispersion of the conductive particles in the medium and the presence of generated bubbles in the conductive paste, and the baking temperature in the fabricating procedures. Therefore, the sintered conductive paste with poor quality shows high current resistant, which may induce degradation of the device and causing deterioration of the instruments and facilities, as a result, restricting the application of the paste.

Polyaniline is a conjugated conductive polymer with good processability and low density. Similar to other conductive polymers, the polyaniline also has high chemical stability, and the conductivity thereof can be adjusted by varying the processing parameters during polymerization. In 1982, the conductivity of the synthesized intrinsic polyaniline is only $10^{-11}$ S/cm, and it was increased to 10 S/cm, proposed by MacDiarmid et al., by doping a protonated acid with an oxidant therein. Although the conductivity of the polyaniline was improved, the solubility of the polyaniline is still too low to be used widely. Recently, it has found that the doped-polyaniline shows great improved stability, and therefore it can be used as an electromagnetic shielding material, an electrode for secondary battery, a heat resistant material, and a solar cell material, etc. Despite the improved solubility of the doped-polyaniline comparing to the intrinsic polyaniline, further improvement of the solubility of the polyaniline is still a critical issue to broaden the applications thereof.

In addition, during the sintering process of the polyaniline-based conductive paste, the water molecules and the dopant adsorbed in the polyaniline chain may be removed, resulting in the de-doping effect and decreasing the conductivity thereof.

Therefore, it is desirable to solve the aforementioned problems to provide better conductive paste having excellent conductivity.

SUMMARY OF THE INVENTION

The object of the present invention is to provide a method for fabricating a conductive paste, and the sintered conductive paste prepared by the method thereof performs significantly improved conductivity.

For further illustration, the conductive paste fabricated by the method of the present invention comprises an organic medium, a carbide, a doped-polyaniline, and an anion surfactant, wherein the carbide can be used as the basis for conductive paste. The stability of dispersion of the carbides and the doped-polyaniline in the medium can be improved by using the anionic surfactant, and more conductive paths can be obtained by adopting the doped-polyaniline as the fillers. Thus, the conductivity of the sintered conductive paste can be improved.

In order to achieve the mentioned object, the present invention provides a method for fabricating the conductive paste, comprising: (a) preparing an organic medium and a mixed powder, wherein the organic medium contains an organic solvent, a resin and a first anionic surfactant, and the mixed powder contains a carbide and a doped-polyaniline, wherein the doped-polyaniline is produced by co-doping a polyaniline with a second anionic surfactant in an acid; and (b) mixing the organic medium and the mixed powder to obtain the conductive paste.

The terms "first" and "second" used herein can be directed various elements, and these elements are not limited by these terms. These terms are only used to distinguish one element from another. For example, a first element could be termed a second element, and, similarly, a second element could be termed a first element, without departing from the scope of exemplary embodiments.

In the step (a), the organic solvent comprises a glycol ether-based solvent and an ester-based solvent, in which examples of the glycol ether-based solvent comprises 2-butoxyethanol, terpineol, or ethanol, and examples of the ester-based solvent comprises triethyl citrate, ethyl acetate, or dibutyl phthalate. However, the organic solvent is not particularly limited thereto. The resin used herein can be, for example, epoxy resin, melamine resin, phenolic resin, resorcinol formaldehyde resin, and polyimide resin. The anionic surfactant used herein can be a $C_{10}$-$C_{30}$ fatty acid salt, a sulfuric ether salt substituted with $C_{10}$-$C_{30}$ alcohol, an alkyl sulfate, or an alkyl sulfonate. Preferably, the anionic surfactant used herein is sodium dodecyl sulfate. However, the present invention is not particularly limited thereto.

The term "alkyl" used herein refers to an aliphatic hydrocarbon group. The alkyl group may be a saturated alkyl group (which means that it does not contain any carbon-carbon double bond or carbon-carbon triple bond) or an unsaturated alkyl group (which means that it contains at least one carbon-carbon double bond or carbon-carbon triple bond). The alkyl moiety, whether saturated or unsaturated, may be branched or straight chain.

Particularly, the organic medium used in the method of the present invention can further comprise at least one selected from the group consisting of a thixotropic agent, a thickening agent and an antifoaming agent. The thixotropic agent used herein is not particularly limited, as long as it can increase the viscosity of the medium in a static state, and decrease the viscosity thereof under a stress. Examples of the thixotropic agent comprise hydrogenated castor oil, silica gas, organic bentonite, and polyamide wax. The thickening agent can be, for example, ethyl cellulose, methyl cellulose, hydroxypropylmethylcellulose, sodium carboxymethyl cellulose, or hydroxyethyl cellulose. The antifoaming agent used herein is not particularly limited, as long as it has the ability to suppress or eliminate of foams in a liquid, such as glycol or silicon oil. For the purpose of mixing the contents of the organic medium uniformly, the step (a) of the method of the present invention further comprises a step of heating and stirring the organic medium at 40° C. to 90° C.

In the method of the present invention, the carbide in the mixed powder of the step (a) is selected from the group consisting of carbon black, carbon fibers, graphite, nanographite flakes, graphene, and carbon nanotubes. The graphite used herein is not particularly limited, and can be graphite powders, graphite flakes, or graphite blocks. Preferably, in one embodiment of the present invention, the carbide used herein is graphite flakes. In addition, the polyaniline in the mixed powder in the step (a) is a doped-polyaniline. Specifically, the doped-polyaniline is obtained by co-doping the polyaniline with the second anionic surfactant and the acid, in which the acid used herein is an inorganic acid, and preferably the inorganic acid is a hydrochloric acid, a sulfuric acid, or a nitric acid. The second anionic surfactant is not particularly limited, and can be $C_{10}$-$C_{30}$ fatty acid salt, a sulfuric ether salt substituted with $C_{10}$-$C_{30}$ alcohol, an alkyl sulfate, or an alkyl sulfonate. The preferable second anionic surfactant is sodium dodecyl sulfate, but the present invention is not particularly limited thereto.

In the step (a) of the method of the present invention, the mixed powder is produced by mixing the carbide, the doped-polyaniline, and a dehydrated alcohol to form a slurry, and then drying the slurry. The weight ratio of the carbide to the doped-polyaniline is in a range from 15:1 to 5:1, and preferably in a range from 12:1 to 8:1. In one embodiment, the weight ratio of the graphite flakes to the doped-polyaniline is approximately 10:1.

In the step (a) of the method of the present invention, the content of the organic solvent can be 30-80 wt %, preferably 45-65 wt %; the content of the resin can be 1-15 wt %, preferably 5-10 wt %; and the content of the anion surfactant is 0.1-1 wt %, preferably 0.1-0.5 wt %, based on the total weight of the organic medium. Furthermore, the content of the carbide can be 10-50 wt %, preferably 20-30 wt %; and the content of the doped-polyaniline can be 1-5 wt %, preferably 2-3 wt %, based on the total weight of the mixed powder. In addition, the doped-polyaniline can be prepared by co-doping polyaniline with the second anionic surfactant in the acid in a molar ratio of 1:1 approximately.

Moreover, the organic medium used in the step (a) of the method of the present invention further comprises additives, such as a thixotropic agent, a thickening agent, and an antifoaming agent. The content of the thixotropic agent can be 0.01-0.5 wt %, preferably 0.05-0.2 wt %; the content of the thickening agent can be 1-20 wt %, preferably 5-15 wt %; and the content of the antifoaming agent can be 1-10 wt %, preferably 2-5 wt %, based on the total weight of the organic medium.

In particular, the organic medium and the mixed powder can be mixed through a biaxial-rolling process or a triaxial-rolling process, so as to form the conductive paste of the present invention.

After the conductive paste fabricated by the method of the present invention is sintered, the obtained sintered conductive paste has significantly improved conductivity. In one embodiment of the present invention, the weight loss of the dopant of the polyaniline based on the thermogravimetry analysis is reduced as the heating rate increased during the sintering process; nevertheless the remaining dopant results in better conductivity of the doped-polyaniline as comparing to the intrinsic one. Therefore, after the heating treatment, the doped-polyaniline can be used for and electrical conductive connection material between carbide particles (such as graphite flakes), and the conductivity of the sintered conductive paste is significantly improved. Furthermore, the stability of the dispersion of the carbides and the doped-polyaniline in the organic medium can be enhanced by the anionic surfactant used herein, and better electrical connection between the carbide particles or between the doped-polyaniline and the carbide particles can also be achieved, as a result, enhancing the conductivity of the conductive paste.

Other objects, advantages, and novel features of the invention will become more apparent from the following detailed description when taken in conjunction with the accompanying drawings.

BRIEF DESCRIPTION OF THE DRAWINGS

FIG. 1 is a schematic view of the processing of the conductive paste in accordance with the present invention.

DETAILED DESCRIPTION OF THE PREFERRED EMBODIMENT

The details of the present invention will be illustrated by the following examples and the accompanied figure. However, the scope of the present invention is not limited by the following examples. Without departing from the spirit of the present invention, a person skilled in the art can accomplish modifications and variations of the present invention.

EXAMPLE

Referring to FIG. 1, a conductive paste of the present embodiment was prepared by the following steps. First, 52.11 wt % of 2-butoxyethanol and 13.03 wt % of ethyl cellulose was mixed and heated at 70° C. for 6 hours to form a mixture. 1.30 wt % of triethyl citrate, 4.43 wt % of glycol and 0.02 wt % of hydrogenated castor oil was further added into the mixture at 70° C. under stirring. Then, 9.6 wt % of epoxy resin was added thereto followed by adding 0.1 wt % sodium dodecyl sulfate, the processes were performed under stirring at 70° C. for obtaining an organic medium having an anion surfactant.

Next, a doped-polyaniline was synthesized by co-doping the aniline with the sodium dodecyl sulfate in a nitric acid solution in a molar ratio of 1:1. The doped-polyaniline, graphite sheets and anhydrous alcohol were mixed by ball milling to form a mixed slurry, in which the weight ratio of the graphite sheets and the doped-polyaniline were 10:1. The mixed slurry was dried in vacuum to obtain a powder mixture.

The powder mixture and the organic medium containing the anion surfactant were mixed uniformly through a triaxial-rolling process to obtain a conductive paste.

Comparative Example

A conductive paste of the present comparative example was prepared in the same manner as those described in the Example, except that the doped-polyaniline was not added therein.

The resistivity of the conductive pastes in accordance with Comparative Example (containing graphite sheets only) and Example (containing both the graphite sheets and the doped-polyaniline) are shown in Table 1. The resistivity of the sintered conductive paste of the Example was reduced from 644.12 mΩ·cm of the Comparative Example to 377.38 mΩ·cm, and the decreasing ratio was approximately 41.41%.

TABLE 1

| Components of the conductive paste | Graphite sheets (Comparative Example) | Graphite sheets and doped-polyaniline (Example) |
|---|---|---|
| Resistivity (mΩ · cm) | 644.12 | 377.38 |

Testing Example 1

First, the weight loss ratio, based on the thermogravimetry analysis, of the doped-polyaniline prepared in the Example was evaluated in the range of 100° C. to 250° C. under different heating rates. Referring to Table 2, the weight loss ratio of the doped-polyaniline was reduced from 26.47 wt % to 22.20 wt %, while the heating rate was increased from 10° C./min to 20° C./min.

TABLE 2

| Heating rate | 10° C./min | 20° C./min |
|---|---|---|
| Loss ratio of the thermogravimetry | 26.47 wt % | 22.20 wt % |

To calculate the total weight loss of the dopant in polyaniline, the temperature ranging from 100° C. to 300° C. under a heating rate of 20° C./min in the thermogravimetric analysis were adopted. The result indicates that the weight loss of the doped-polyaniline of Example during 200° C. to 270° C. was about 32.13 wt % which is the total amount of dopant. Therefore, the residual dopant of 30% can be calculated, based on the thermogravimetric analysis, when the polyaniline was heated to 250° C. Because of the presence of dopant in polyaniline, the doped-polyaniline can form conductive networks between the graphite sheets to improve the conductivity of the conductive paste.

The influences of each component on the conductivity of the conductive pastes were evaluated according to the following Testing Example 2 and Testing Example 3.

Testing Example 2

The influence of adding sodium dodecyl sulfate on the resistivity of the conductive paste was studied in the present example. In the control group, the composition and the processing method of the conductive paste were the same as the above Example, except that the epoxy resin was not added therein. In the experimental group, the composition and the processing method of the conductive paste were also the same as the above Example, except that the epoxy resin and the sodium dodecyl sulfate were not added therein. The results are shown in Table 3.

TABLE 3

| Conductive paste | Experimental group | Control group |
|---|---|---|
| Resistivity (mΩ · cm) | 66.73 | 23.66 |

According to the results depicted in Table 3, the resistivity of the conductive paste containing the sodium dodecyl sulfate as the anion surfactant was 23.66 mΩ·cm, shown a reduced ratio of 64.54%.

Testing Example 3

Adhesive Test

The adhesive capability and the conductivity of the conductive paste including the epoxy resin were tested in the present testing example. The conductive paste of the Example of the present invention was sintered at 250° C. The conductive paste of the Example was used in the control group. On the other hand, the conductive paste used in the experimental group was similar to that of Example, except that the epoxy resin was not added therein.

The adhesive capability was tested by attaching the 3M tape on the sintered conductive paste and tearing the tape off after 1 min. The results are shown in the following Table 4.

TABLE 4

| Conductive paste | Experimental group | Control group |
|---|---|---|
| Resistivity (mΩ · cm) | 23.66 | 30.84 |
| Adhesive ability | A lot of powders were detached from the surface of the conductive paste | A few powders were detached form the surface of the conductive paste |

Referring to the results shown in Table 4, although the resistivity of the conductive paste was slightly increased from 23.66 mΩ·cm into 30.84 mΩ·cm by adding the epoxy resin therein, the adhesive capability thereof was greatly improved. Comparing with the commercial conductive paste with a thickness of 25 μM, the resistance thereof has to be 25Ω/square, corresponding to a resistivity of 65 mΩ·cm; however, the commercial conductive paste was tested and a resistivity of 98.15 mΩ·cm was obtained. A large amount of powders were detached under the aforementioned adhesive test, representing the conductive paste of the present invention is superior to the commercial conductive paste. In addition, the resistivity of the conductive paste of the present invention is 30.84 mΩ·cm, which is apparently improved, in comparison with that of the commercial conductive paste (98.15 mΩ·cm). Therefore, the conductive paste of the present invention improves not only the adhesive capability thereof but also the resistivity thereof, and shows excellent conductivity.

Although the present invention has been explained in relation to its preferred embodiment, it is to be understood that many other possible modifications and variations can be made without departing from the spirit and scope of the invention as hereinafter claimed.

What is claimed is:

1. A method for fabricating a conductive paste comprising:

(a) preparing an organic medium and a mixed powder, wherein the organic medium contains an organic solvent, a resin and a first anionic surfactant, and the mixed powder contains a carbide and a doped-polyaniline, wherein the doped-polyaniline is produced by co-doping a polyaniline with a second anionic surfactant in an acid, wherein the first anionic surfactant is a $C_{10}$-$C_{30}$ fatty acid salt, a sulfuric ether salt substituted with $C_{10}$-$C_{30}$ alcohol, or an alkyl sulfonate; and (b) mixing the organic medium and the mixed powder to obtain the conductive paste.

2. The method according to claim 1, wherein the organic solvent comprises a glycol ether-based solvent and an ester-based solvent.

3. The method according to claim 1, wherein the organic medium further comprises at least one selected from the group consisting of a thixotropic agent, a thickening agent and an antifoaming agent.

4. The method according to claim 1, wherein the step (a) further comprises heating the organic medium at 40° C. to 90° C. after forming the organic medium.

5. The method according to claim 1, wherein the carbide is at least one selected from the group consisting of carbon black, carbon fibers, graphite, nano-graphite flakes, graphene, and carbon nanotubes.

6. The method according to claim 1, wherein the acid is an inorganic acid.

7. The method according to claim 6, wherein the inorganic acid is a hydrochloric acid, a sulfuric acid, or a nitric acid.

8. The method according to claim 1, wherein the second anionic surfactant in the step (a) is a $C_{10}$-$C_{30}$ fatty acid salt, a sulfuric ether salt substituted with $C_{10}$-$C_{30}$ alcohol, an alkyl sulfate, or an alkyl sulfonate.

9. The method according to claim 1, wherein the mixed powder is produced by mixing the carbide, the doped-polyaniline, and a dehydrated alcohol to form a slurry, then drying the slurry.

10. The method according to claim 1, wherein the weight ratio of the carbide to the doped-polyaniline is 8:1 to 12:1.

11. The method according to claim 1, wherein in the step (a), the content of the organic solvent is 45-65 wt %, the content of the resin is 5-10 wt %, and the content of the anion surfactant is 0.1-0.5 wt %, based on the total weight of the organic medium.

12. The method according to claim 1, wherein in the step (b), the content of the carbide is 20-30 wt %, and the content of the doped-polyaniline is 2-3 wt %, based on the total weight of the mixed powder.

13. The method according to claim 1, wherein the organic medium and the mixed powder is mixed through a biaxial-rolling process or a triaxial-rolling process.

* * * * *